US008884829B2

(12) United States Patent
Chi et al.

(10) Patent No.: US 8,884,829 B2
(45) Date of Patent: Nov. 11, 2014

(54) WIRELESS COMMUNICATION DEVICE

(71) Applicants: Chuan-Chou Chi, New Taipei (TW); Chih-Yang Tsai, New Taipei (TW); Pai-Cheng Huang, New Taipei (TW); Hao-Ying Chang, New Taipei (TW)

(72) Inventors: Chuan-Chou Chi, New Taipei (TW); Chih-Yang Tsai, New Taipei (TW); Pai-Cheng Huang, New Taipei (TW); Hao-Ying Chang, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 130 days.

(21) Appl. No.: 13/647,482

(22) Filed: Oct. 9, 2012

(65) Prior Publication Data

US 2013/0259486 A1 Oct. 3, 2013

(30) Foreign Application Priority Data

Mar. 27, 2012 (TW) ..... 101110647

(51) Int. Cl.
*H01Q 1/24* (2006.01)
*H01Q 21/28* (2006.01)

(52) U.S. Cl.
CPC ..... *H01Q 1/243* (2013.01); *H01Q 21/28* (2013.01)
USPC ..... 343/702; 343/876

(58) Field of Classification Search
CPC ..... H01Q 1/243; H01Q 3/24; H01Q 21/28
USPC ..... 343/702, 876, 787
See application file for complete search history.

(56) References Cited

U.S. PATENT DOCUMENTS 7,937,124 B2 * 5/2011 Chung et al. ..... 455/575.2
8,115,687 B2 * 2/2012 Kezys et al. ..... 343/702
8,159,399 B2 * 4/2012 Dorsey et al. ..... 343/702

* cited by examiner

*Primary Examiner* — Hoang V Nguyen
(74) *Attorney, Agent, or Firm* — Novak Druce Connolly Bove + Quigg LLP

(57) ABSTRACT

A wireless communication device includes a first antenna, a second antenna, a first light sensor adjacent to the first antenna, a second light sensor adjacent to the second antenna, a controller, and a magnetic member movably located between the first antenna and the second antenna. When one of the first and second antennas in a state of receiving/transmitting wireless signals is covered by a user's hand, the nearby light sensor sends a pulse signal to the controller. The controller receiving the pulse signal controls the first and second antennas to change their magnetic polarity, enabling the magnetic member to be separated from one of the first and second antennas and attached to the another one, thereby choosing one of the first and second antennas, or a combination of one of the two antennas and the magnetic member to receive/transmit the wireless signals.

18 Claims, 4 Drawing Sheets

WIRELESS COMMUNICATION DEVICE

BACKGROUND

1. Technical Field

The present disclosure relates to wireless communication devices.

2. Description of Related Art

Many wireless communication devices (such as mobile phones) have multiple working frequency bands. Thus, multiple antennas corresponding to the working frequency bands are secured inside the devices, such as a GSM/CDMA wireless communication antenna, a WIFI antenna, and a GPS antenna. These antennas are usually located at different positions inside the devices to prevent mutual interference. However, when users are holding the devices to use, it is inevitable that one or more of the antennas are covered by users' hands, which reduces a radiation efficiency of the antennas, thus degrading communication functions of the wireless communication devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawing like reference numerals designate corresponding parts throughout the views.

DETAILED DESCRIPTION

Figure 1:
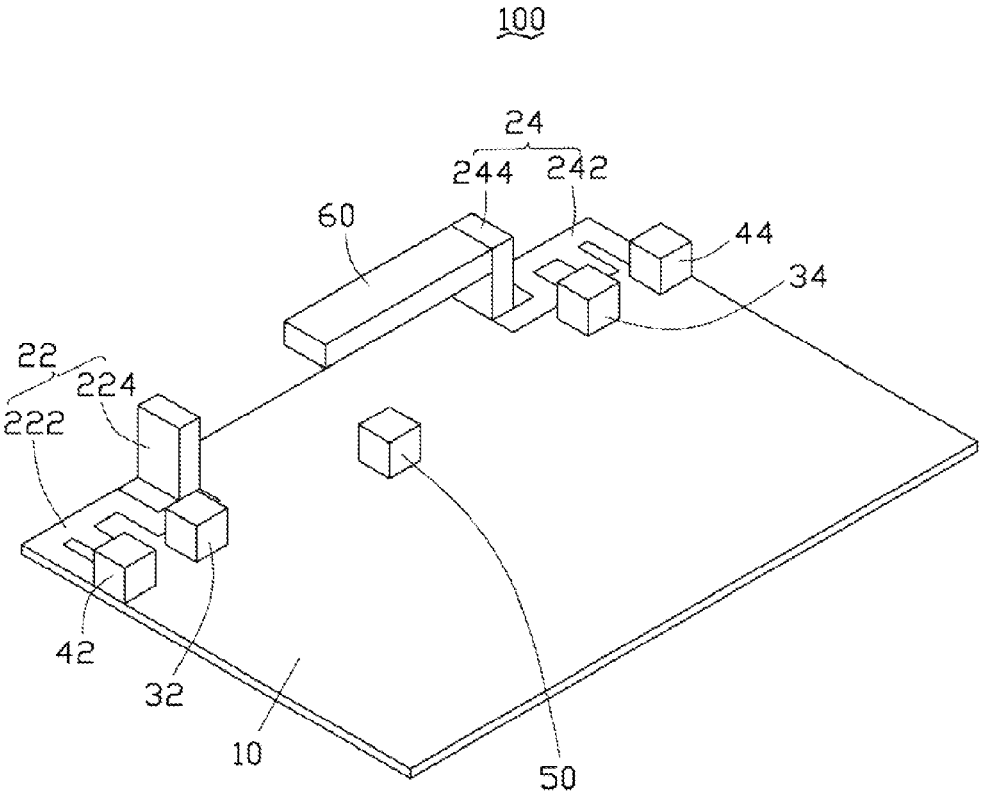
FIG. 1 is an isometric view of a wireless communication device in accordance with an exemplary embodiment.

FIG. 1 shows an exemplary embodiment of a wireless communication device 100. The wireless communication device 100 may be a mobile phone or a personal digital assistant, etc. In the exemplary embodiment, the wireless communication device 100 includes a supporting member 10, a first antenna 22, a second antenna 24, a first light sensor 32, a second light sensor 34, a first magnetic inductor 42, a second magnetic inductor 44, a controller 50, and a magnetic member 60.

The supporting member 10 may be a printed circuit board (PCB) of the wireless communication device 100. The first antenna 22, the second antenna 24, the first light sensor 32, the second light sensor 34, the first magnetic inductor 42, the second magnetic inductor 44, and the controller 50 are all mounted to the supporting member 10.

The first antenna 22 and the second antenna 24 have substantially the same shape and are made of conductive materials, such as metal. The first antenna 22 and the second antenna 24 are respectively positioned at two opposite ends of the supporting member 10. The first antenna 22 has a main portion 222 and a bonding portion 224. The main portion 222 is flat. The main portion 222 is attached to the supporting member 10 and electronically connected to the supporting member 10. The bonding portion 224 protrudes perpendicularly from the main portion 222. The bonding portion 224 is thicker than the main portion 222. The first antenna 22 can be used to receive/transmit a first wireless signal, for example WIFI signals. The second antenna 24 has a main section 242 and a bonding section 244. The main section 242 is flat. The main section 242 is attached to the supporting member 10 and electronically connected to the supporting member 10. The bonding section 244 protrudes perpendicularly from the main section 242 and is opposite to the bonding portion 224 of the first antenna 22. The bonding section 244 is thicker than the main section 242. The second antenna 24 can be used to receive/transmit a first wireless signal, for example WIFI signals.

Figure 2:
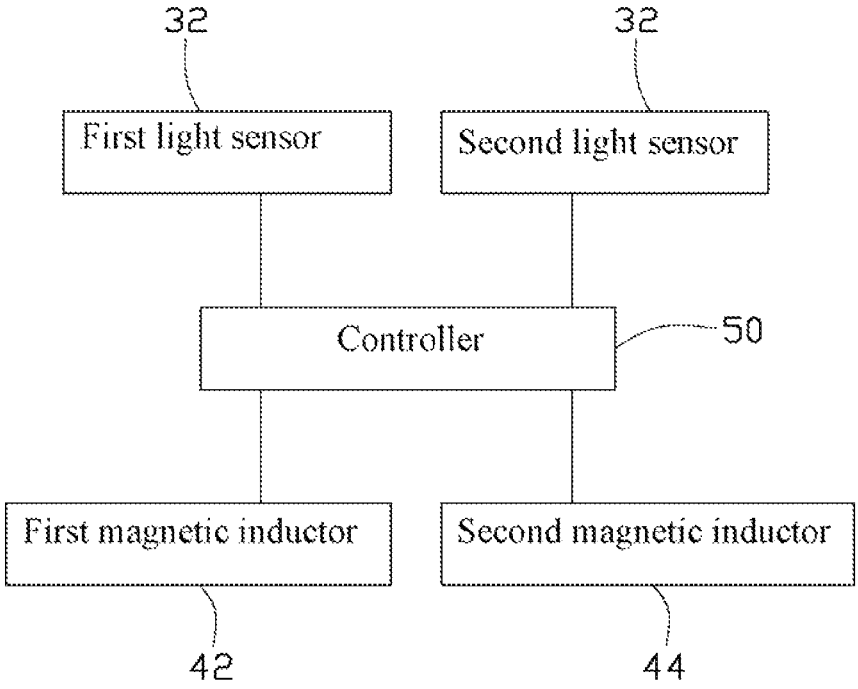
FIG. 2 is a partial block diagram of the wireless communication device of FIG. 1.

Referring to FIGS. 1 and 2, the first light sensor 32 and the second light sensor 34 are electronically connected to the controller 50 and are adjacent to the first antenna 22 and the second antenna 24, respectively. The first and second sensors 32, 34 originally may have ambient or environmental light irradiating thereon. When the first antenna 22 or the second antenna 24 is covered by a user's hand, the light originally irradiating on the nearby first light sensor 32 or the second light sensor 34 is blocked by the hand. Accordingly, the first light sensor 32 or the second light sensor 34 which has light blocked sends a pulse signal to the controller 50.

In the exemplary embodiment, the first magnetic inductor 42 and the second magnetic inductor 44 both are Hall units and connect with the main portion 222 of the first antenna 22 and the main section 242 of the second antenna 24, respectively. The first and second magnetic inductors 42, 44 each can act as a north magnetic pole or a south magnetic pole under the control of the controller 50, thereby enabling the first antenna 22 and the second antenna 24 to act as a corresponding magnetic pole. For example, when the first magnetic inductor 42 is controlled to be a south magnetic pole, the first antenna 22 is also a south magnetic pole; when the first magnetic inductor 42 is controlled to be a north magnetic pole, the first antenna 22 also acts as a north magnetic pole; when the second magnetic inductor 44 is controlled to be a south magnetic pole, the second antenna 24 also acts as a south magnetic pole; when the second magnetic inductor 44 is controlled to be a north magnetic pole, the second antenna 24 also acts as a north magnetic pole.

The controller 50 is electronically connected to the first magnetic inductor 42 and the second magnetic inductor 44. The controller 50 controls the first and second magnetic inductors 42, 44 to change their magnetic polarity according to the pulse signals sent by the first light sensor 32 or the second light sensor 34 and the current states of receiving/transmitting wireless signals of the first and second antennas 22, 24. Specifically, when the first antenna 22 is in a state of receiving/transmitting wireless signals and is covered by a user's hand, the controller 50 receives a pulse signal sent by the first light sensor 32 and controls the first and second magnetic inductors 42, 44 to change their magnetic polarity. When the second antenna 24 is in a state of receiving/transmitting wireless signals and is covered by a user's hand, the controller 50 receives a pulse signal sent by the second light sensor 34 and controls the first and second magnetic inductors 42, 44 to the change their magnetic polarity. However, when the first antenna 22 or the second antenna 24 are not in a state of receiving/transmitting wireless signals and are covered by a user's hand, the controller 50 will not control the first magnetic inductor 42 or the second magnetic inductor 44 to change their magnetic polarity.

The magnetic member 60 is made of a conductive material. In the exemplary embodiment, the magnetic member 60 is a magnet. The magnetic member 60 is positioned above the supporting member 10 and can be moved between the bonding portion 224 of the first antenna 22 and the bonding section 244 of the second antenna 24. The magnetic member 60 is shorter than the distance between the bonding portion 222 and the bonding section 242. The magnetic member 60 has a south magnetic pole and a north magnetic pole. In the exemplary embodiment, an end of the magnetic member 60 adjacent to the main portion 222 is defined as the north magnetic pole and an end of the magnetic member 60 adjacent to the main section 242 is defined as the south magnetic pole.

The operating principle of the wireless communication device 100 is further described as follows.

In the exemplary embodiment, the first and second magnetic inductors 42, 44 both initially act as north magnetic poles. The magnetic member 60 is attracted by and attached to the main section 242 of the second antenna 24. Thus, the first antenna 22 can receive/transmit a first wireless signal (such as WIFI signal). The current path between the second antenna 24 and the magnetic member 60 is in a certain proportion to the wavelength of a second wireless signal (such as GPS signal). Thus, the second antenna 24 and the magnetic member 60 can cooperatively receive/transmit the second wireless signal.

Figure 3:
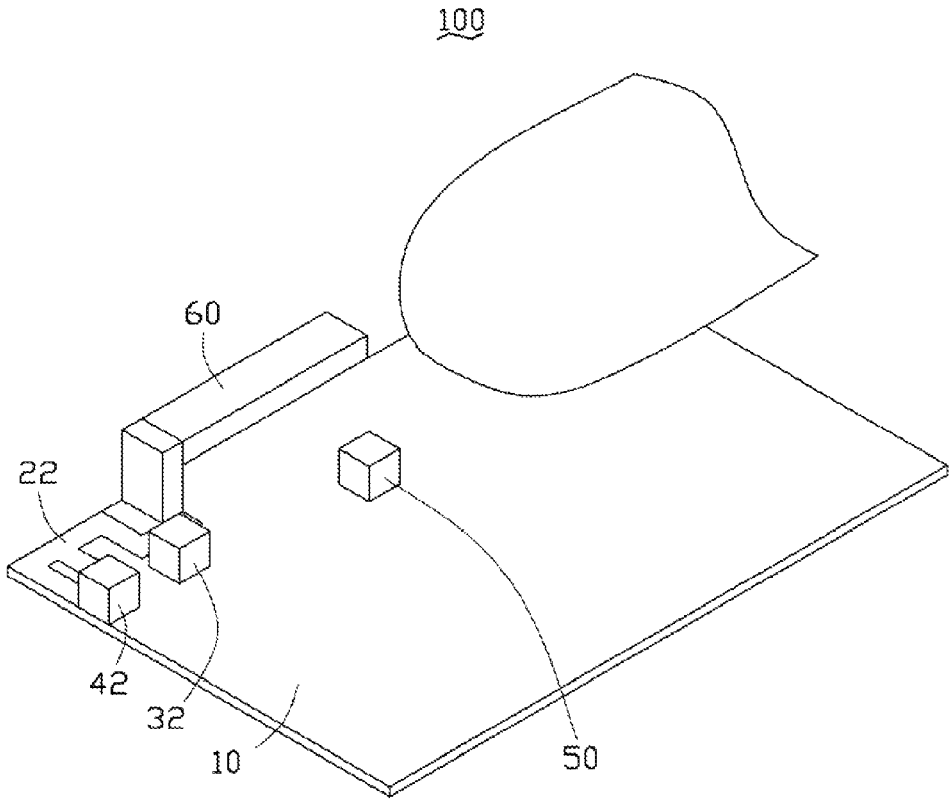
FIG. 3 is an isometric view of the wireless communication device of FIG. 1 in an operating state.

Referring to FIG. 3, when the wireless communication device 100 is required to receive/transmit the second wireless signal, the second antenna 24 is in a state of receiving/sending wireless signals. In this case, if the first antenna 22 which is not in a state of receiving/transmitting wireless signals is covered by the user's hand, the controller 50 does not act to interrupt the second antenna 24 receiving/transmitting the second wireless signal. If the second antenna 24 is covered by the user's hand, the light originally irradiating on the second light sensor 34 is blocked, causing the second light sensor 34 to send a pulse signal to the controller 50. After receiving the pulse signal, the controller 50 controls the first and second magnetic inductors 42, 44 to change their magnetic polarity. That is, the first and second magnetic inductors 42, 44 change from north magnetic pole to be south magnetic pole. Accordingly, the first and second antennas 22, 24 also change to be south magnetic pole. Thus, the magnetic member 60 separates from the second antenna 24 and is attracted by and attached to the first antenna 22, enabling the first antenna 22 and the magnetic member 60 cooperatively to receive/transmit the second wireless signal. Therefore, the wireless communication device 100 can continue to receive/transmit the second wireless signal by the first antenna 22 in case of the second antenna 24 being covered, preventing the reduced radiation efficiency of the second antenna 24 to adversely affect the receiving/transmitting of the second wireless signal.

Figure 4:
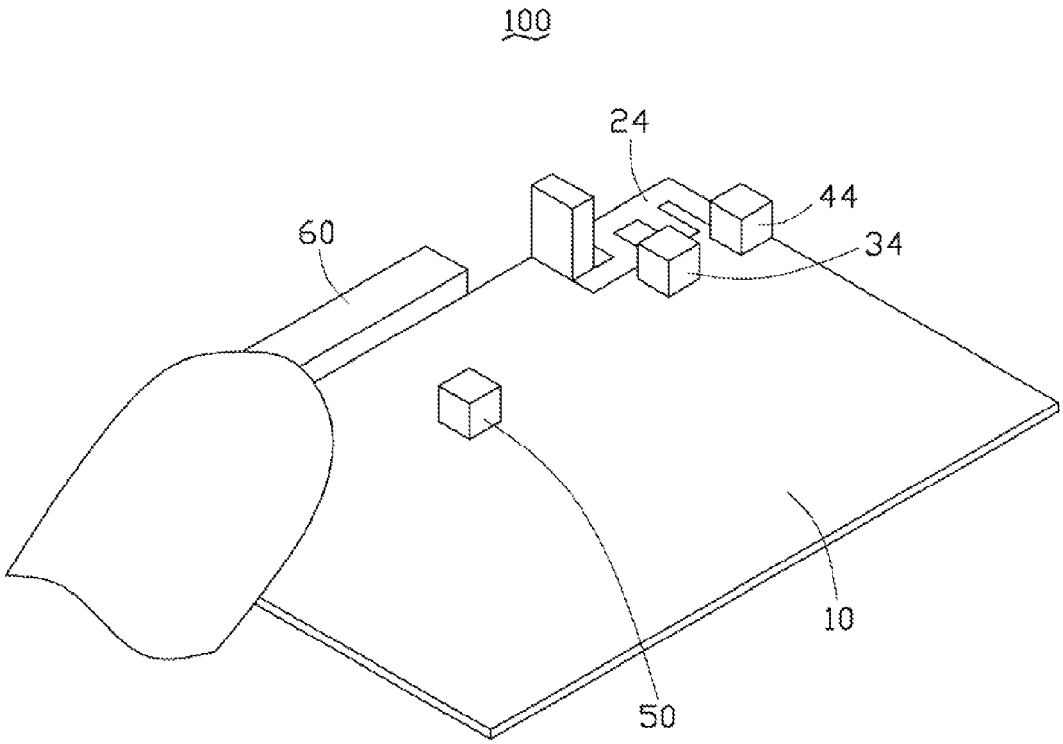
FIG. 4 is an isometric view of the wireless communication device of FIG. 1 in another operating state.

Referring to FIG. 4, when the wireless communication device 100 is required to receive/transmit the first wireless signal, the first antenna 22 is in a state of receiving/transmitting wireless signals. In this case, if the second antenna 24 which is not in a state of receiving/transmitting wireless signals is covered by the user's hand, the controller 50 does not act to interrupt the first antenna 22 receiving/transmitting the second wireless signal. If the first antenna 22 is covered by the user's hand, the light originally irradiating on the first light sensor 32 is blocked, causing the first light sensor 32 to send a pulse signal to the controller 50. After receiving the pulse signal, the controller 50 controls the first and second magnetic inductors 42, 44 to change their magnetic polarity. That is, the first and second magnetic inductors 42, 44 change from north magnetic pole to be south magnetic pole. Accordingly, the first and second antennas 22, 24 also change to be south magnetic pole. Thus, the magnetic member 60 separates from the second antenna 24 and is attracted by and attached to the first antenna 22, enabling the second antenna 24 to receive/transmit the first wireless signal. Therefore, the wireless communication device 100 can continue to receive/transmit the first wireless signal by the second antenna 24 in case of the first antenna 22 being covered, preventing the reduced radiation efficiency of the first antenna 22 to adversely affect the receiving/transmitting of the first wireless signal.

It should be understood, that the initial magnetic polarity of the first and second magnetic inductors 42, 44 can be south magnetic poles. In this case, the principle for receiving/transmitting wireless signals of the device 100 is the same as above described.

It should be understood, that device 100 should not be limited to receive/transmit the first and second wireless signals. The device 100 can also receive/transmit wireless signals of different frequency bands more than two by increasing antennas mounted to the supporting member 10.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:
a first antenna;
a second antenna;
a first light sensor adjacent to the first antenna;
a second light sensor adjacent to the second antenna;
a controller electronically connected to the first light sensor and the second light sensor; and
a magnetic member movably located between the first antenna and the second antenna;
wherein the first and second antennas have the same initial magnetic polarity, when one of the first and second antennas is in a state of receiving/transmitting wireless signals and is covered, one of the first and second light sensors adjacent to the covered antenna sends a pulse signal to the controller, the controller receiving the pulse signal controls the first and second antennas to change their magnetic polarity, enabling the magnetic member to be separated from one of the first and second antennas and attracted by and attached to the other of the antennas, thereby choosing one of the first antenna, second antenna, a combination of the first antenna and the magnetic member, and a combination of the second antenna and the magnetic member to receive/transmit the wireless signals.

2. The wireless communication device as claimed in claim 1, further comprising a first magnetic inductor and a second magnetic inductor connecting with the first antenna and the second antenna, respectively; the controller controls the first and second magnetic inductors to change their magnetic polarity, thereby changing the magnetic polarity of the first and second antennas.

3. The wireless communication device as claimed in claim 2, wherein the first and second magnetic inductors are Hall units.

4. The wireless communication device as claimed in claim 2, wherein when the controller receives the pulse signal send by the first light sensor and the first antenna is in the state of receiving/transmitting wireless signals, the controller controls the first and second magnetic inductors to change their magnetic polarity; when the controller receives the pulse signal send by the second light sensor and the second antenna is in the state of receiving/transmitting wireless signals, the controller controls the first and second magnetic inductors to change their magnetic polarity.

5. The wireless communication device as claimed in claim 2, further comprising a supporting member; the first and second antennas have substantially the same shape and are positioned at two opposite ends of the supporting member, respectively.

6. The wireless communication device as claimed in claim 5, wherein the first antenna has a main portion and a bonding portion; the main portion is flat and attached to the supporting member and electronically connected to the supporting member; the bonding portion protrudes perpendicularly from the main portion; the second antenna has a main section and a bonding section; the main section is flat and attached to the supporting member and electronically connected to the supporting member; the bonding section protrudes perpendicularly from the main section and opposite to the bonding portion of the first antenna.

7. The wireless communication device as claimed in claim 6, wherein the first magnetic inductor connects with the bonding portion of the first antenna; the second magnetic inductor connects with the bonding section of the second antenna.

8. The wireless communication device as claimed in claim 6, wherein the magnetic member is positioned above the supporting member and movably located between the bonding portion and the bonding section; the magnetic member being shorter than the distance between the bonding portion and the bonding section.

9. The wireless communication device as claimed in claim 1, wherein the first and second antennas are used for receiving/transmitting a first wireless signal; the combination of combination of the first antenna and the magnetic member and the combination of the second antenna and the magnetic member are used for receiving/transmitting a second wireless signal.

10. The wireless communication device as claimed in claim 1, wherein the first and second antennas are made of a conductive material; the magnetic member is made of a conductive material.

11. A wireless communication device, comprising:

a first antenna;

a second antenna;

a first light sensor adjacent to the first antenna;

a second light sensor adjacent to the second antenna;

a controller electronically connected to the first light sensor and the second light sensor; and a magnetic member movably located between the first antenna and the second antenna;

wherein the first and second antennas have the same initial magnetic polarity, when the first antenna in a state of receiving/transmitting a first wireless signal is covered, the first light sensor sends a pulse signal to the controller, the controller receiving the pulse signal controls the first and second antennas to change their magnetic polarity, enabling the magnetic member to be separated from the second antenna and attracted by and attached to the first antenna, thereby the second antenna receiving/transmitting the first wireless signal.

12. The wireless communication device as claimed in claim 11, further comprising a first magnetic inductor and a second magnetic inductor connecting with the first antenna and the second antenna, respectively; the controller controls the first and second magnetic inductors to change their magnetic polarity, thereby changing their magnetic polarity of the first and second antennas.

13. The wireless communication device as claimed in claim 12, wherein the first and second magnetic inductors are Hall units.

14. The wireless communication device as claimed in claim 12, further comprising a supporting member; the first and second antennas have substantially the same shape and are positioned at two opposite ends of the supporting member, respectively.

15. The wireless communication device as claimed in claim 14, wherein the first antenna has a main portion and a bonding portion; the main portion is flat attached to the supporting member and electronically connected to the supporting member; the bonding portion protrudes perpendicularly from the main portion; the second antenna has a main section and a bonding section; the main section is flat attached to the supporting member and electronically connected to the supporting member; the bonding section protrudes perpendicularly from the main section and opposite to the bonding portion of the first antenna.

16. The wireless communication device as claimed in claim 15, wherein the first magnetic inductor connects with the bonding portion of the first antenna; the second magnetic inductor connects with the bonding section of the second antenna.

17. The wireless communication device as claimed in claim 15, wherein the magnetic member is positioned above the supporting member and movably located between the bonding portion and the bonding section; the magnetic member has a length less than the distance between the bonding portion and the bonding section.

18. The wireless communication device as claimed in claim 11, wherein the first and second antennas are made of a conductive material; the magnetic member is made of a conductive material.

* * * * *